US007464496B1

(12) United States Patent
Davies et al.

(10) Patent No.: US 7,464,496 B1
(45) Date of Patent: Dec. 16, 2008

(54) HEAT EXCHANGER BARREL NUT

(76) Inventors: Robert B. Davies, 433 E. McKinley St., Tempe, AZ (US) 85281-1026; Frank Desomma, 23623 N. 67th Ave., Glendale, AZ (US) 85310

( * ) Notice: Subject to any disclaimer, the term of this patent is extended or adjusted under 35 U.S.C. 154(b) by 278 days.

(21) Appl. No.: 11/442,035

(22) Filed: May 26, 2006

(51) Int. Cl.
*F41A 21/48* (2006.01)

(52) U.S. Cl. ..... 42/75.02; 89/14.1

(58) Field of Classification Search ..... 42/75.02; 89/14.1
See application file for complete search history.

(56) References Cited

U.S. PATENT DOCUMENTS

| | | | | | |
|---|---|---|---|---|---|
| 1,290,853 | A * | 1/1919 | Sturgeon | 89/14.1 |
| 1,357,208 | A * | 10/1920 | Payne | 42/75.01 |
| 1,402,459 | A * | 1/1922 | Swebilius | 89/184 |
| 1,789,835 | A * | 1/1931 | Pedersen | 89/14.1 |
| 1,879,603 | A * | 9/1932 | Coupland | 89/14.1 |
| 2,102,622 | A * | 12/1937 | Green | 89/14.1 |
| 2,110,165 | A * | 3/1938 | Moore | 42/75.02 |
| 2,116,141 | A * | 5/1938 | Browning | 89/193 |
| 2,287,066 | A * | 6/1942 | Rogers | 89/14.05 |
| 2,391,864 | A * | 1/1946 | Chandler | 42/18 |
| 2,935,912 | A * | 5/1960 | Hartley | 89/14.1 |
| 3,118,243 | A * | 1/1964 | Manshel | 42/76.02 |
| 3,908,214 | A * | 9/1975 | DeLoreto | 470/19 |
| 4,576,083 | A * | 3/1986 | Seberger, Jr. | 89/14.4 |
| 4,765,224 | A * | 8/1988 | Morris | 89/191.01 |
| 5,634,288 | A * | 6/1997 | Martel | 42/71.01 |
| 6,113,285 | A * | 9/2000 | Ward | 385/93 |
| 6,217,205 | B1 * | 4/2001 | Ward | 362/580 |
| 6,508,159 | B1 * | 1/2003 | Muirhead | 89/14.1 |
| 6,606,812 | B1 * | 8/2003 | Gwinn, Jr. | 42/75.02 |
| 6,694,660 | B1 * | 2/2004 | Davies | 42/75.01 |
| 6,827,130 | B2 * | 12/2004 | Larson | 165/80.3 |
| 6,848,351 | B1 * | 2/2005 | Davies | 89/191.01 |
| 6,921,181 | B2 * | 7/2005 | Yen | 362/206 |
| 2003/0010186 | A1 * | 1/2003 | Muirhead | 89/14.1 |
| 2003/0010187 | A1 * | 1/2003 | Muirhead | 89/14.1 |
| 2005/0262997 | A1 * | 12/2005 | Brixius | 89/14.1 |
| 2006/0010748 | A1 * | 1/2006 | Stoner et al. | 42/71.01 |

* cited by examiner

*Primary Examiner*—Troy Chambers
*Assistant Examiner*—Jonathan C Weber
(74) *Attorney, Agent, or Firm*—Parson & Goltry; Robert A. Parsons; Michael W. Goltry

(57) ABSTRACT

A barrel nut for coupling a barrel of a firearm to a receiver includes a body having a first end, an opposing second end, and an outer surface. A bore extends centrally through the body from the first end to the second end. A plurality of heat conducting fins extends radially outwardly from the outer surface of the body. A fastening element fastens the breach end of the barrel nut to the receiver.

18 Claims, 5 Drawing Sheets

HEAT EXCHANGER BARREL NUT

FIELD OF THE INVENTION

This invention relates to firearms.

More particularly, the present invention relates to barrel replacement and exchange technology.

BACKGROUND OF THE INVENTION

Firearms such as the AR-15, AR-10, M16 and the like include a receiver having a stock coupled to one end and a barrel coupled to the opposing end. A breach end of the barrel is received by the receiver and a barrel nut is used to fix the barrel in position. Over time, firing rounds through a firearm will degrade the mechanism and the barrel. While the barrel can be readily replaced, and damaged parts can also be replaced, replacement can be expensive. Even more important, during military and law enforcement use, the need to replace parts can occur at very inconvenient times posing a danger to the user. Additionally, prior to replacement, the accuracy of the barrel can be degraded by wear and/or distortion.

To a large degree, the degradation and even damage to the firearm can be attributed to excessive heating of metallic parts such as the barrel and elements within the receiver such as the extractor. During use, particularly in military situations where automatic fire is employed, high levels of heat are generated by the detonating cartridge and even more is generated by the friction of the bullet passing through the barrel. The heat is collected in the barrel and to some degree in the receiver. To protect a user, a firearm typically includes a handguard covering the barrel nut and the barrel. Unfortunately, while protecting a user, the handguard also contains the heat of the barrel, preventing dissipation. Barrel heat has long been known to cause damage, and has been addressed by the use of water jackets for water cooling in heavy machine guns and with perforated sleeves or handguards for air circulation. While somewhat effective for cooling the barrel, heat collected at the breach end of the barrel and within the receiver has not been addressed. Excessive heating and subsequent cooling can damage and degrade the barrel, the receiver and parts within the receiver.

It would be highly advantageous, therefore, to remedy the foregoing and other deficiencies inherent in the prior art.

Accordingly, it is an object of the present invention to provide a new and improved barrel nut to provide cooling of the breach end of the barrel and receiver to prevent excessive heating.

SUMMARY OF THE INVENTION

Briefly, to achieve the desired objects of the present invention in accordance with a preferred embodiment thereof, provided is a barrel nut for coupling a barrel of a firearm to a receiver. The barrel nut includes a body having a first end, an opposing second end, and an outer surface. A bore extends centrally through the body from the first end to the second end. A plurality of heat conducting fins extends radially outwardly from the outer surface of the body. A fastening element fastens the breach end of the barrel nut to the receiver. The fastening element can include a threaded counter bore extending from the first end toward the second end and terminating in a shoulder.

In a specific aspect a plurality of apertures are formed through the plurality of fins peripherally around the body for receiving portions of an operating system. An inner surface of the body defining the bore is for closely overlying the barrel and transferring heat to the plurality of fins.

In yet another aspect, a heat conducting material is carried within the bore for increasing heat conduction between a rifle barrel and the body. A seal member is carried within the bore at the second end for engagement with the barrel to retain the heat conducting fluid within the body.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 10 is an enlarged partial view illustrating the muzzle end of the barrel nut.

DETAILED DESCRIPTION OF THE PREFERRED EMBODIMENT

Figure 1:
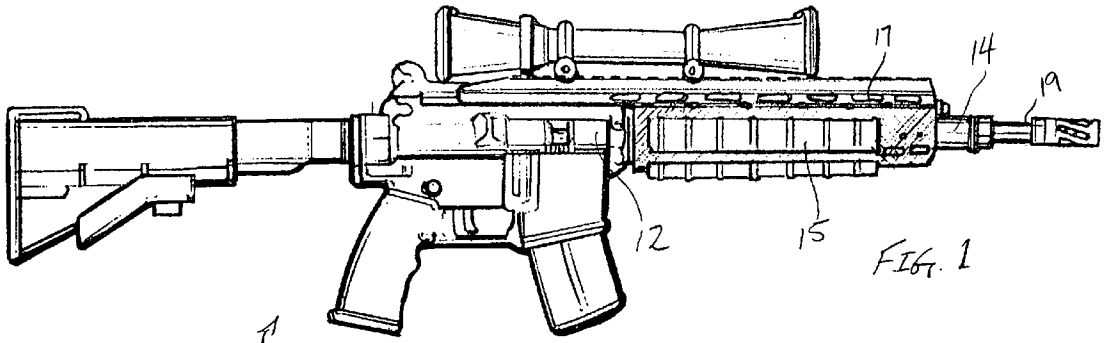
FIG. 1 is a side view of a firearm according to the present invention.

Turning now to the drawings in which like reference characters indicate corresponding elements throughout the several views, attention is first directed to FIG. 1 which illustrates a firearm generally designated 10. Firearm 10 includes a receiver 12 having a barrel 14 attached thereto. A handguard 15 is coupled to barrel 14 and includes air passages 17 therethrough providing airways to allow air movement. Air passages 17 can be provided encircling the handguard and can be of the type disclosed in U.S. Pat. No. 6,694,660, issued 24 Feb. 2004, entitled Rifle Handguard System With Integrated Barrel Nut, incorporated by reference herein. With additional reference to FIGS. 2 and 3, barrel 14 includes a breach end 18 (FIG. 9) and a muzzle end 19. Barrel 14 is coupled to receiver 12 by a heat exchanger barrel nut generally designated 20. Barrel nut 20 couples barrel 14 to receiver 12 in a conventional manner therefore the coupling of the barrel is not described in greater detail but is well known for M16 and like firearms.

Turning now to FIGS. 4-8, heat exchanger barrel nut 20 includes a body 22 having a breach end 23, an opposing muzzle end 24, and an outer surface 25. For purposes of orientation, a direction toward the receiver will be referred to as the breach direction and toward the muzzle as the muzzle direction. A bore 28 defined by an inner surface 29 of body 22 extends centrally through body 22 from breach end 23 to muzzle end 24. Bore 28 is sized to permit barrel nut 20 to be received over the muzzle of barrel 14 and slid toward breach end 18. While of sufficient diameter to be received over barrel 14, inner surface 29 is intended to engage or closely overly barrel 14 in order to conduct heat from breach end 18 and draw heat away from receiver 12. Barrel nut 20 is fabricated of a heat conducting material, such as steel, carbon fiber, titanium and the like, but is preferably of aluminum for its cost effectiveness, heat conduction and light weight.

Body 22, while preferably a unitary element, can be considered in two portions. An attachment portion 30 at breach end 23 and a heat exchange portion 32 at muzzle end 24. A fastening element for fastening breach end 23 of barrel nut 20 to receiver 12 is carried at breach end as attachment portion 30. The fastening element in this preferred embodiment includes a threaded counter bore 34 extending from breach end 23 toward muzzle end 24 and terminating in a shoulder 35. In many firearms, a flange is present proximate breach end 18 of barrel 14. Shoulder 35 engages the flange and compresses it against receiver 12. While this is a common attachment mechanism, one skilled in the art will understand that other mechanism for attaching barrel nut 20 to receiver 12 are commonly used and can be employed with this device.

A plurality of heat conducting fins 40 extends radially outwardly from outer surface 25 of body 22 at heat exchange portion 32 to conduct heat from body 22. Each of the plurality of fins 40 encircles body 22 and is parallel to one another intermediate breach end and muzzle end. The plurality of fins 40 provides a large surface area for heat dissipation conducted from receiver 12 and barrel 14. Gaps 42 between fins 40 permit air circulation therearound aiding in heat dissipation. Thus, heat is transferred from receiver 12 and barrel 14 through body 22 to fins 40.

As can be seen, outer surface 25 of body 22 at attachment portion 30 has a diameter substantially equal to the diameter of fins 40. This facilitates the use of the handguard system discussed previously and incorporated by reference herein. However, one skilled in the art will understand that the outer surface can be uniform from breach end to muzzle end. The greater thickness of body 22 at attachment portion 30 insures strong and rigid attachment of barrel 14 to receiver 12 and support for the handguard. The reduced thickness of body 22 at heat exchange portion 32 with fins 40 extending therefrom greatly increases surface area and air flow for greater heat dissipation. The overall length of barrel nut 20 has been increased from conventional barrel nuts. The length can be increased or decreased depending on the number of fins 40 desired.

Figure 2:
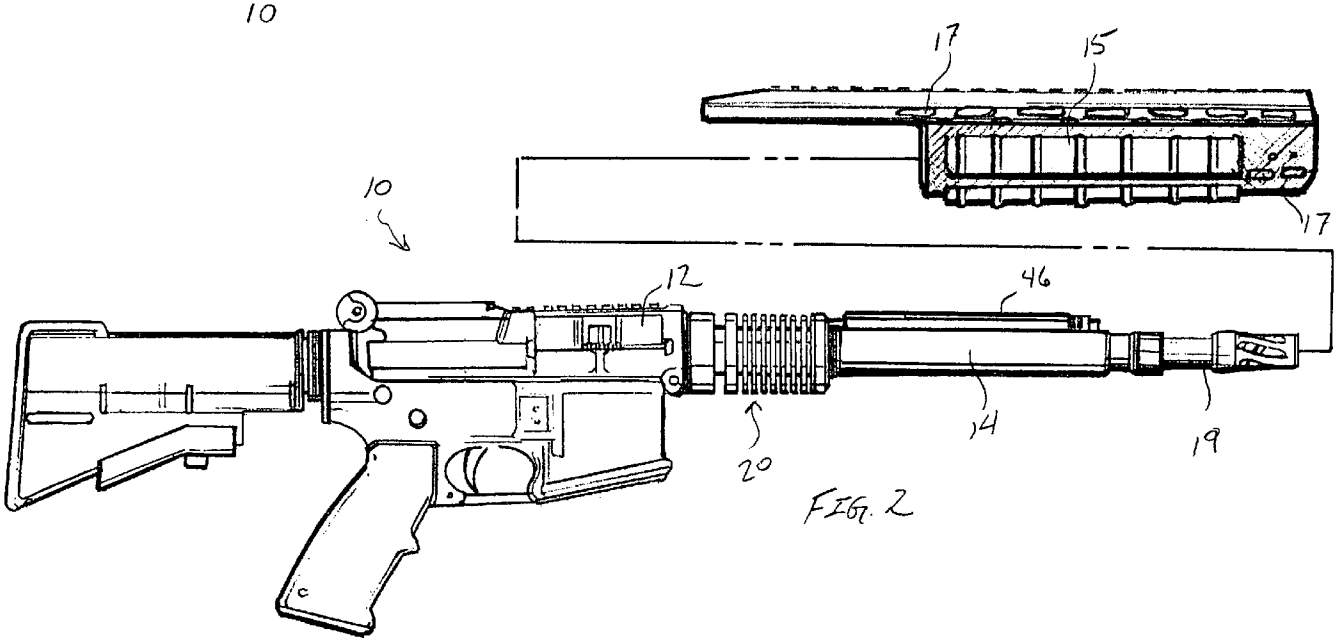
FIG. 2 is a side view of FIG. 1 with the handguard removed.
Figure 3:
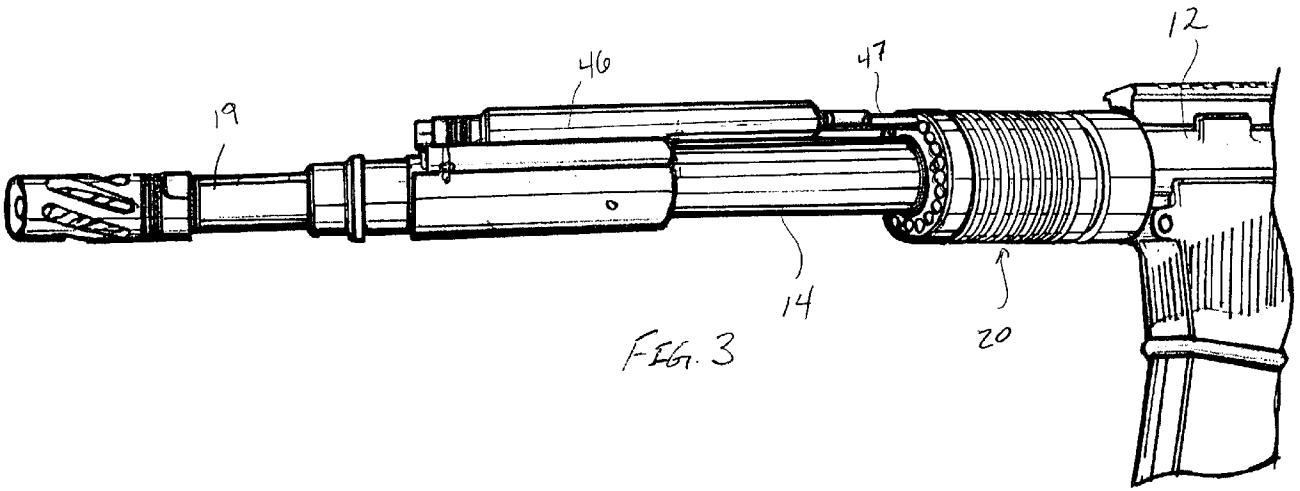
FIG. 3 is a partial view of the firearm of FIG. 2 illustrating the barrel nut according the present invention.
Figure 4:
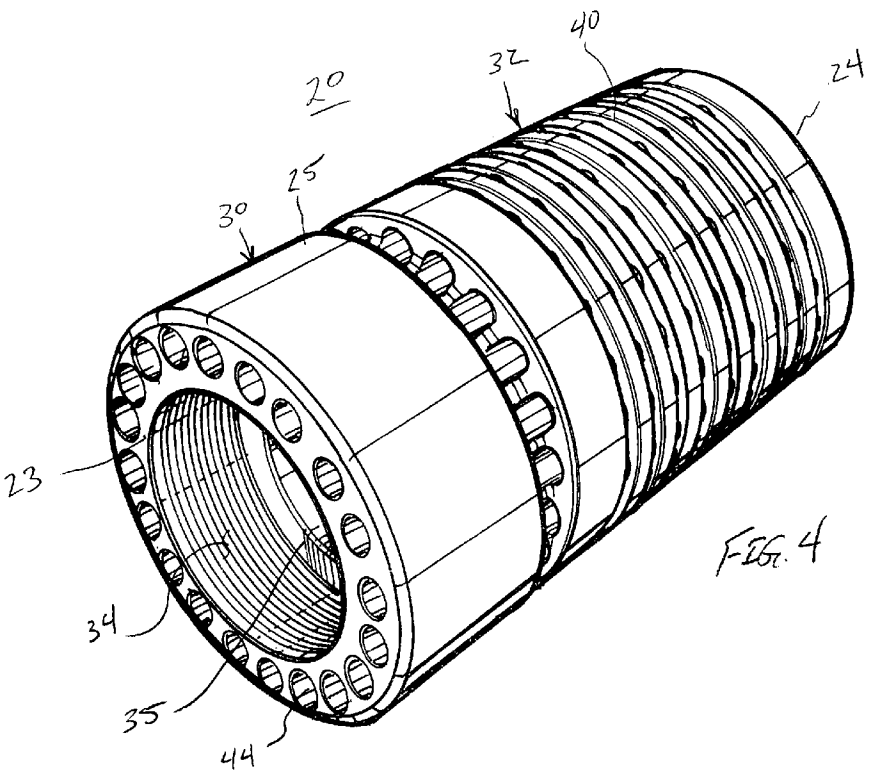
FIG. 4 is a perspective view of the barrel nut according to the present invention.
Figure 6:
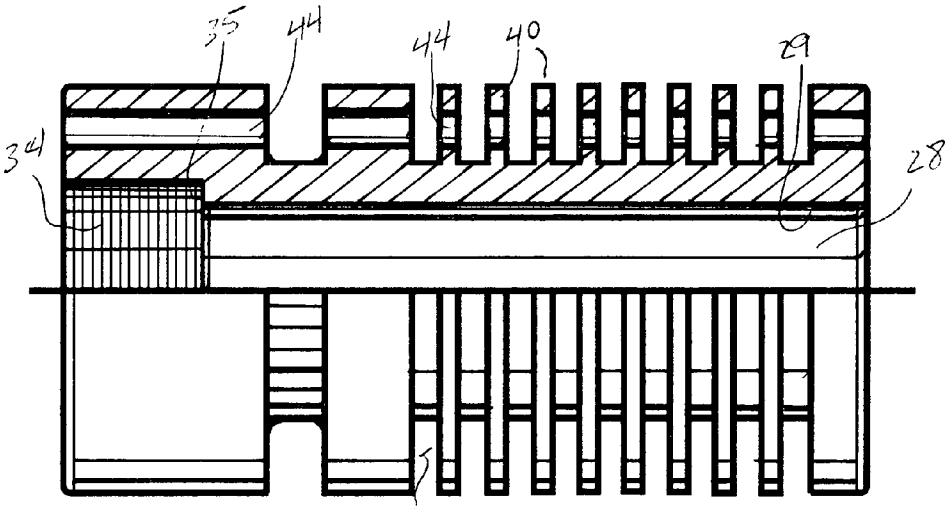
FIG. 6 is a partial sectional side view of the barrel nut of FIG. 5.
Figure 7:
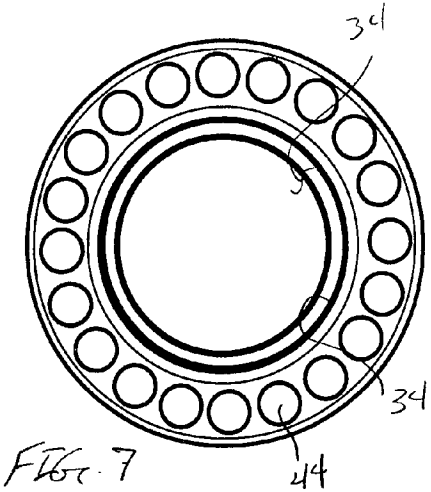
FIG. 7 is a breach end view of the barrel nut of FIG. 5.
Figure 8:
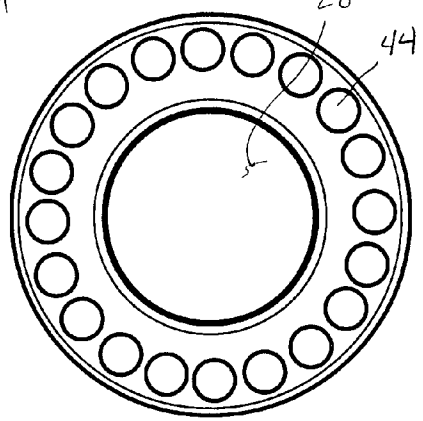
FIG. 8 is a muzzle end view of the barrel nut.
Figure 5:
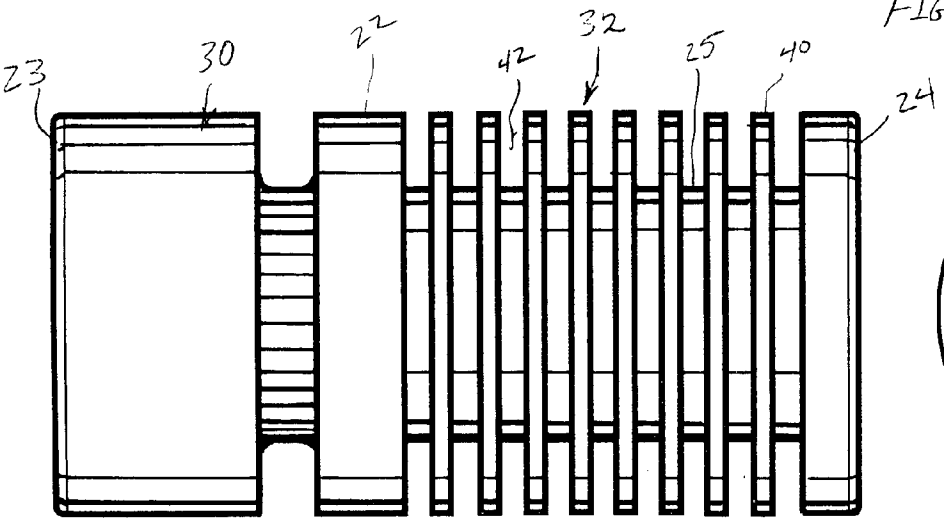
FIG. 5 is a side elevation of the barrel nut of FIG. 4.

A plurality of apertures 44 is formed through the plurality of fins 40 at heat exchange portion 32 and through body 22 at attachment portion 30. Apertures 44 are positioned peripherally around body 22 and extend longitudinally from breach end 23 to muzzle end 24 for receiving portions of an operating system 46 (FIGS. 2 and 3). Portion of operating system 46 can include a gas tube, a push rod 47 (illustrated) and the like. Provision of a plurality of apertures 44 insures that one of apertures 44 is correctly positioned for receipt of the portion of operating system 46 after barrel nut 20 is threaded onto receiver 12.

Figures 9, 11:
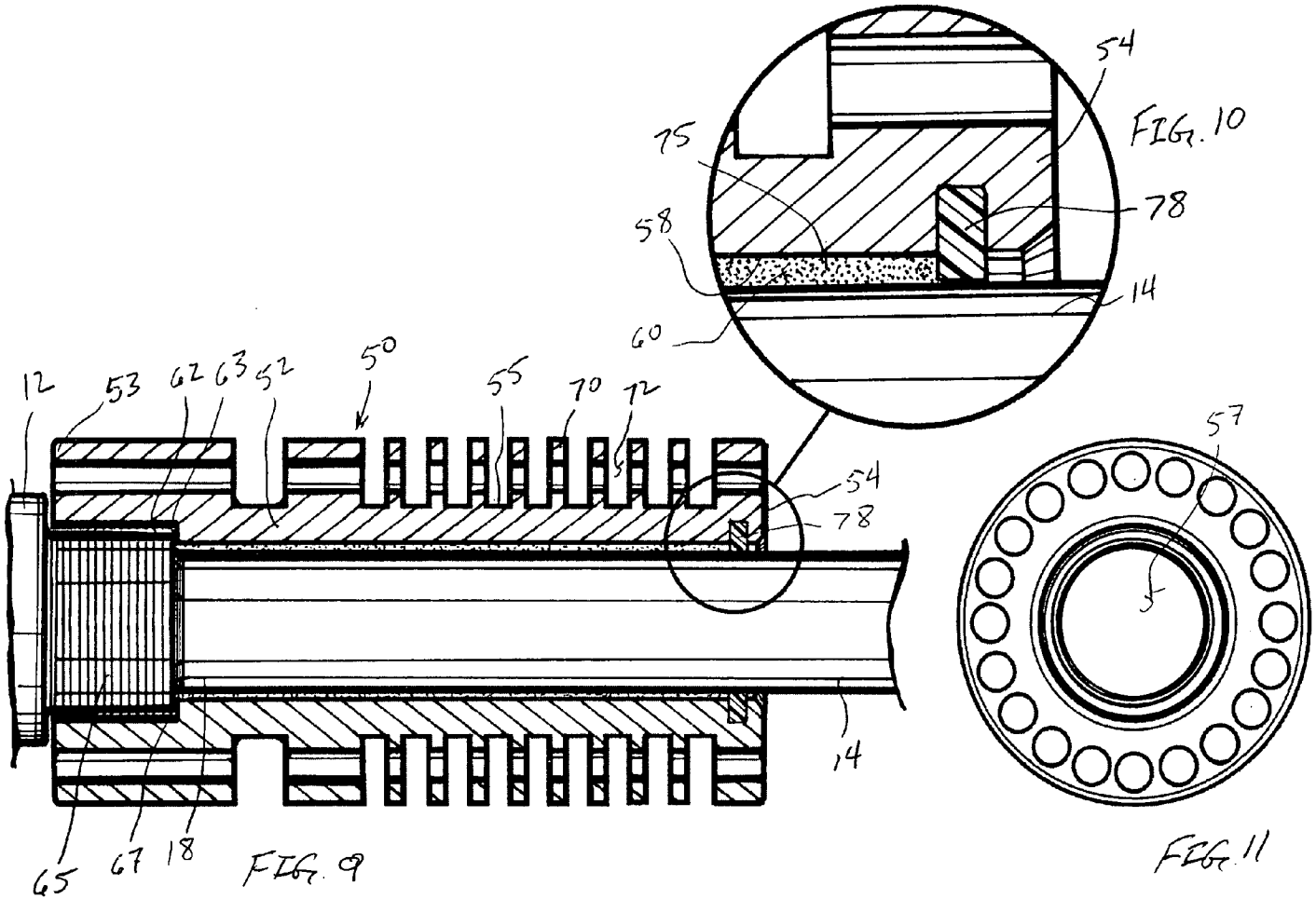
FIG. 9 is a sectional side view of another embodiment of a barrel nut as it appears securing a barrel to a receiver.
FIG. 11 is a muzzle end view of the barrel nut of FIG. 9.

Turning now to FIGS. 9-11, another embodiment of a heat exchanger barrel nut generally designated 50 is illustrated. A barrel 14 is coupled to receiver 12 by heat exchanger barrel nut 50. Barrel nut 50 is substantially identical to barrel nut 20, and includes a body 52 having a breach end 53, an opposing muzzle end 54, and an outer surface 55. A bore 57 defined by an inner surface 58 of body 52 extends centrally through body 52 from breach end 53 to muzzle end 54. Bore 57 is sized to permit barrel nut 50 to be received over the muzzle of barrel 14 and slid toward breach end 18. A slight space 60 is provided between inner surface 58 and barrel 14, for purposes which will be described presently.

A fastening element for fastening breach end 53 of barrel nut 50 to receiver 12 is carried at breach end 53. The fastening element in this preferred embodiment includes a threaded counter bore 62 extending from breach end 53 toward muzzle end 54 and terminating in a shoulder 63. Receiver 12 includes a portion 65 with threads on an outer surface thereof. Breach end 18 of barrel 14 is received within portion 65. In many firearms, a flange 67 is present around breach end 18 of the barrel 14. Flange 67 abuts the end of portion 65. Counter bore 62 threads onto portion 65 with shoulder 63 engaging flange 67 and compressing it against receiver 12. While this is a common attachment mechanism, one skilled in the art will understand that other mechanism for attaching the barrel nut to the receiver are commonly used and can be employed with this device.

A plurality of heat conducting fins 70 extends radially outwardly from outer surface 55 of body 52 to conduct heat from body 52. Each of the plurality of fins 70 encircles body 52 and is parallel to one another intermediate breach end 53 and muzzle end 54. The plurality of fins 70 provides a large surface area for heat dissipation conducted from receiver 12 and barrel 14. Gaps 72 between fins 70 permit air circulation therearound aiding in heat dissipation. Thus, heat is transferred from receiver 12 and barrel 14 through body 52 to fins 70. As can be seen with particular reference to FIG. 10, a heat conducting material 75 is carried within bore 57 for increasing heat conduction between barrel 14 and body 52. Heat conducting material 75 can be substantially any material to improve the conduction of heat between barrel 14 and body 52, such as solids, pastes, fluids and the like, and can be removable or permanent. As examples of materials, ceramic adhesive and thermal grease can be used. If a fluid material is used, a seal member 78 is carried within bore 57 at muzzle end 54. Seal Member 78 engages barrel 14 to retain a fluid heat conducting material 75 within body 52.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A barrel nut for coupling a barrel of a firearm to a receiver, the barrel nut comprising:

a body having a first end, an opposing second end, and an outer surface;

a bore extending centrally through the body from the first end to the second end;

a plurality of heat conducting fins extending radially outwardly from the outer surface of the body; and a fastening element for fastening the first end of the barrel nut to the receiver.

2. A barrel nut as claimed in claim 1 wherein the fastening element includes a threaded counter bore extending from the first end toward the second end and terminating in a shoulder.

3. A barrel nut as claimed in claim 1 wherein a plurality of apertures is formed through the plurality of fins peripherally around the body for receiving portions of an operating system.

4. A barrel nut as claimed in claim 1 wherein an inner surface of the body defining the bore is for closely overlying the barrel and transferring heat to the plurality of fins.

5. A barrel nut as claimed in claim 4 further including a heat conducting material carried within the bore for increasing heat conduction between a rifle barrel and the body.

6. A barrel nut as claimed in claim 5 further including a seal member carried within the bore at the second end for engagement with the barrel to retain the heat conducting material within the body.

7. A barrel nut coupling a barrel of a firearm to a receiver comprising:

a barrel of a firearm having a breach end and a muzzle end;

a receiver of a firearm receiving the breach end of the barrel;

a body having a first end, an opposing second end, and an outer surface;

a bore extending centrally through the body from the first end to the second end;

a threaded counter bore extending from the first end toward the second end and terminating in a shoulder;

a plurality of heat conducting fins extending radially outwardly from the outer surface of the body, each of the plurality of fins encircling the body and parallel to one another intermediate the first end and the second end; and a fastening element fastening the first end of the barrel nut and the breach end of the barrel to the receiver.

8. A barrel nut as claimed in claim 7 wherein a plurality of apertures is formed through the plurality of fins peripherally around the body for receiving portions of an operating system.

9. A barrel nut as claimed in claim 7 wherein an inner surface of the body defining the bore is for closely overlying the barrel and transferring heat to the plurality of fins.

10. A barrel nut as claimed in claim 9 further including a heat conducting material carried within the bore for increasing heat conduction between the barrel and the body.

11. A barrel nut as claimed in claim 10 further including a seal member carried within the bore at the second end engaging the barrel to retain the heat conducting material within the body.

12. A barrel nut coupling a barrel having a breach end and a muzzle end to a receiver of a firearm comprising:

a body having a first end, an opposing second end, and an outer surface;

a bore extending centrally through the body from the first end to the second end receiving the barrel therein;

a plurality of heat conducting fins extending radially outwardly from the outer surface of the body; and a fastening element fastening the first end of the barrel nut and the breach end of the barrel to the receiver.

13. A barrel nut as claimed in claim 12 wherein the fastening element includes a threaded counter bore extending from the first end toward the second end and terminating in a shoulder.

14. A barrel nut as claimed in claim 12 wherein a plurality of apertures is formed through the plurality of fins peripherally around the body for receiving portions of an operating system.

15. A barrel nut as claimed in claim 12 wherein an inner surface of the body defining the bore closely overlies the barrel and transfers heat to the plurality of fins.

16. A barrel nut as claimed in claim 15 further including a heat conducting material carried within the bore increasing heat conduction between the barrel and the body.

17. A barrel nut as claimed in claim 16 further including a seal member carried within the bore at the second end engaging the barrel to retain the heat conducting material between the barrel and the body.

18. A barrel nut as claimed in claim 12 further including a handguard covering the barrel and barrel nut, the handguard having air passages corresponding to gaps between the fins to promote air flow.

* * * * *